US005242584A

United States Patent [19]

Hoarau

[11] Patent Number: 5,242,584

[45] Date of Patent: Sep. 7, 1993

[54] ALL-FLUID SEPTIC TANK WITH INCORPORATED LIQUID COLLECTOR

[76] Inventor: Patrick Hoarau, 75 rue Leconte de Lisle, F-97434 Saint Gilles les Bains, France

[21] Appl. No.: 824,158

[22] Filed: Jan. 22, 1992

[30] Foreign Application Priority Data

Jan. 24, 1991 [FR] France ..... 91 00790

[51] Int. Cl.[5] ..... C02F 11/00

[52] U.S. Cl. ..... 210/170; 210/299; 210/532.2

[58] Field of Search ..... 210/170, 295, 299, 300, 210/316, 532.1, 532.2

[56] References Cited

U.S. PATENT DOCUMENTS

| | | | |
|---|---|---|---|
| 210,572 | 12/1878 | Slevin | 210/170 |
| 2,364,472 | 12/1944 | Piatt | 210/532.2 |
| 3,109,813 | 11/1963 | Bergsten et al. | 210/532.2 |
| 3,332,552 | 7/1967 | Zabel | 210/532.2 |
| 3,568,838 | 3/1971 | Appelgren et al. | 210/170 |
| 3,794,176 | 2/1974 | Schnyder | 210/532.2 |
| 3,898,162 | 8/1975 | Carlson et al. | 210/170 |
| 4,224,155 | 9/1980 | Milne | 210/170 |
| 4,439,323 | 3/1984 | Ball | 210/532.2 |
| 4,501,665 | 2/1985 | Wilhelnson | 210/532.2 |
| 4,789,487 | 12/1988 | Wallace | 210/170 |
| 4,997,562 | 3/1991 | Warner | 210/532.2 |

FOREIGN PATENT DOCUMENTS

| | | |
|---|---|---|
| 0038255 | 10/1981 | European Pat. Off. . |
| 0240412 | 10/1987 | European Pat. Off. . |
| 2554843 | 5/1985 | France . |
| 2610653 | 8/1988 | France . |

*Primary Examiner*—Peter Hruskoci
*Assistant Examiner*—Robert James Popovics
*Attorney, Agent, or Firm*—Armstrong, Westerman, Hattori, McLeland & Naughton

[57] ABSTRACT

The tank incorporates a sole collector chamber (11) for collecting degradable substances via an intake pipe (14), as well as for collecting waste water via a plurality of inlet orifices (15) provided on said chamber, these orifices having variable diameters and distributed over the height and periphery of said chamber.

Application for tanks connected to an underground irrigation system or other infiltration devices.

6 Claims, 2 Drawing Sheets

ALL-FLUID SEPTIC TANK WITH INCORPORATED LIQUID COLLECTOR

FIELD OF THE INVENTION

The invention concerns a septic tank for processing waste or sewerage water for private dwellings and more particularly concerns a tank with an incorporated liquid collector.

BACKGROUND OF THE INVENTION

Septic tanks, whether made of synthetic materials obtained by moulding or via brickwork, are used to recover degradable materials but are also often used to collect domestic sewerage originating from runoffs, from washbasins, sinks, machines, etc., as it clearly being much simpler to avoid providing a runoff collector by the side of a house. Up until now, a degradable substances intake pipe usually has been provided at one extremity of the tank and an outlet to the irrigation zone at the opposite extremity so that decantation, fermentation of the organic degradable substances and the flotation of sludge is effected correctly inside the tank. When the tank is required to also recover sewerage water, it is more suitable to direct these towards the degradable substances intake pipe or directly towards the tank from a waste water collector situated further away, this system thus involving the need for additional work to be carried out.

The inventor has found that it would be much easier to incorporate inside a prefabricated septic tank a sole collector for collecting the the degradable substances and also waste water which can be inspected by means of a single chamber and which accordingly overcomes those drawbacks relating to known solutions. This integration proves to be advantageous in that it concerns the adjacent incorporation of an interchangeable cartridge anticlogging prefilter system, such as the one described in FR-A 2 610 653. Thus, a single-block tank is provided which is able to directly receive all intake pipes for intaking fluid originating from all directions.

SUMMARY OF THE INVENTION

One object of the present invention is to provide a septic tank comprising at least one pipe for receiving degradable substances and one pipe for evacuating these substances in the irrigation direction, as well as at least one sealable upper opening able to form a manhole, the tank also incorporating a sole collector chamber for collecting degradable substances via an intake pipe, as well as waste water via a plurality of inlet orifices provided on said chamber, the latter communicating with the cistern of the tank by means of an outlet.

To this effect, the upper portion of the cistern comprises two circular openings, one being adapted to receive the sole collector chamber and the other a basin used as a support for an interchangeable prefilter cartridge, the two openings preferably having the same diameter so as to indifferently receive the collector chamber or the prefilter cartridge basin.

According to another particular characteristic of the invention, the inlet orifices for waste water provided in the sole collector chamber have variable diameters and are distributed over the height and periphery of said chamber.

BRIEF DESCRIPTION OF THE DRAWINGS

The other characteristics and advantages of the invention shall appear more readily from a reading of the following description of one embodiment example with reference to the accompanying drawings in which.

DETAILED DESCRIPTION OF THE PREFERRED EMBODIMENTS

Figure 1:
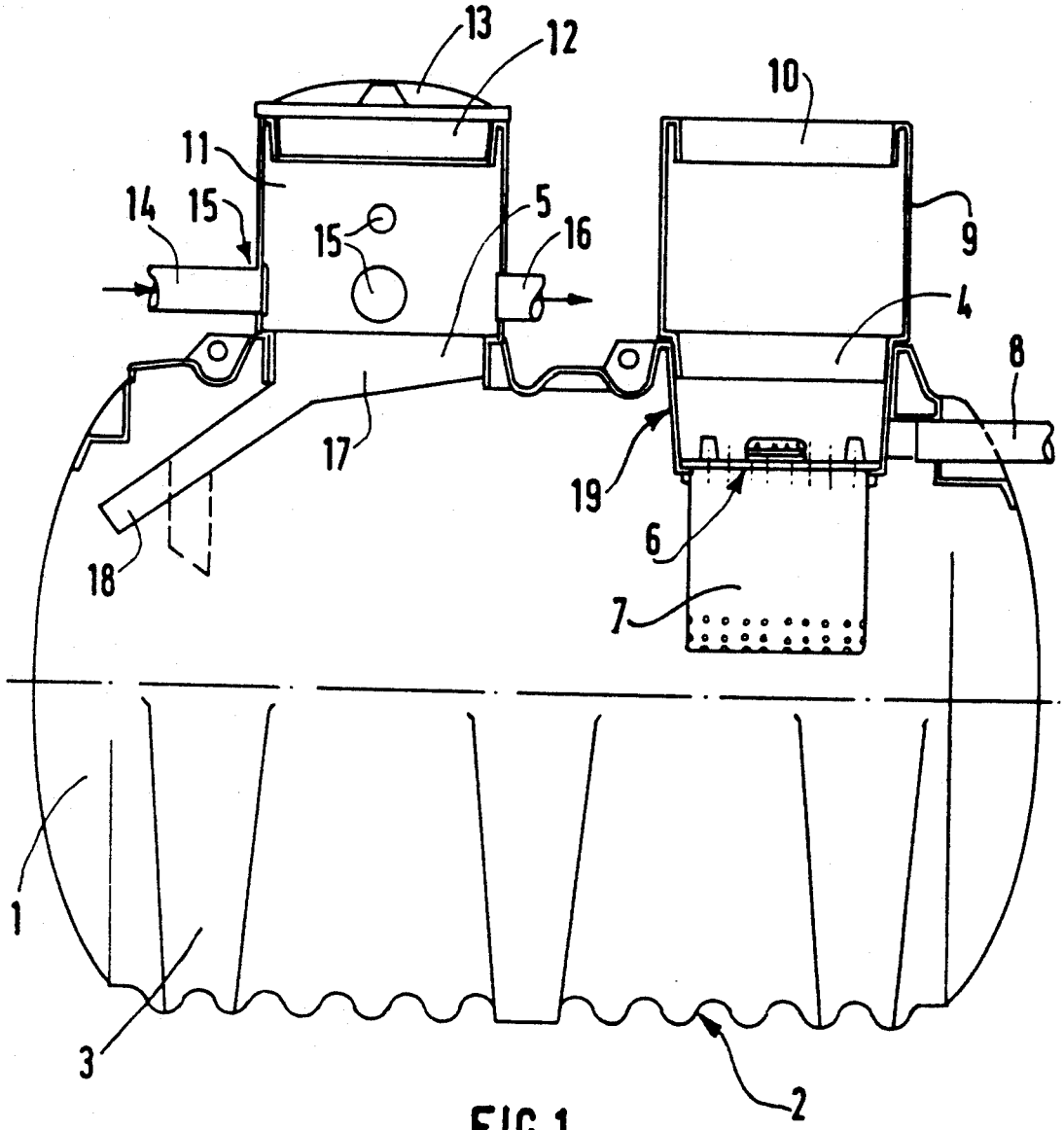
FIG. 1 is a vertical longitudinal cutaway view of the tank.
Figure 2:
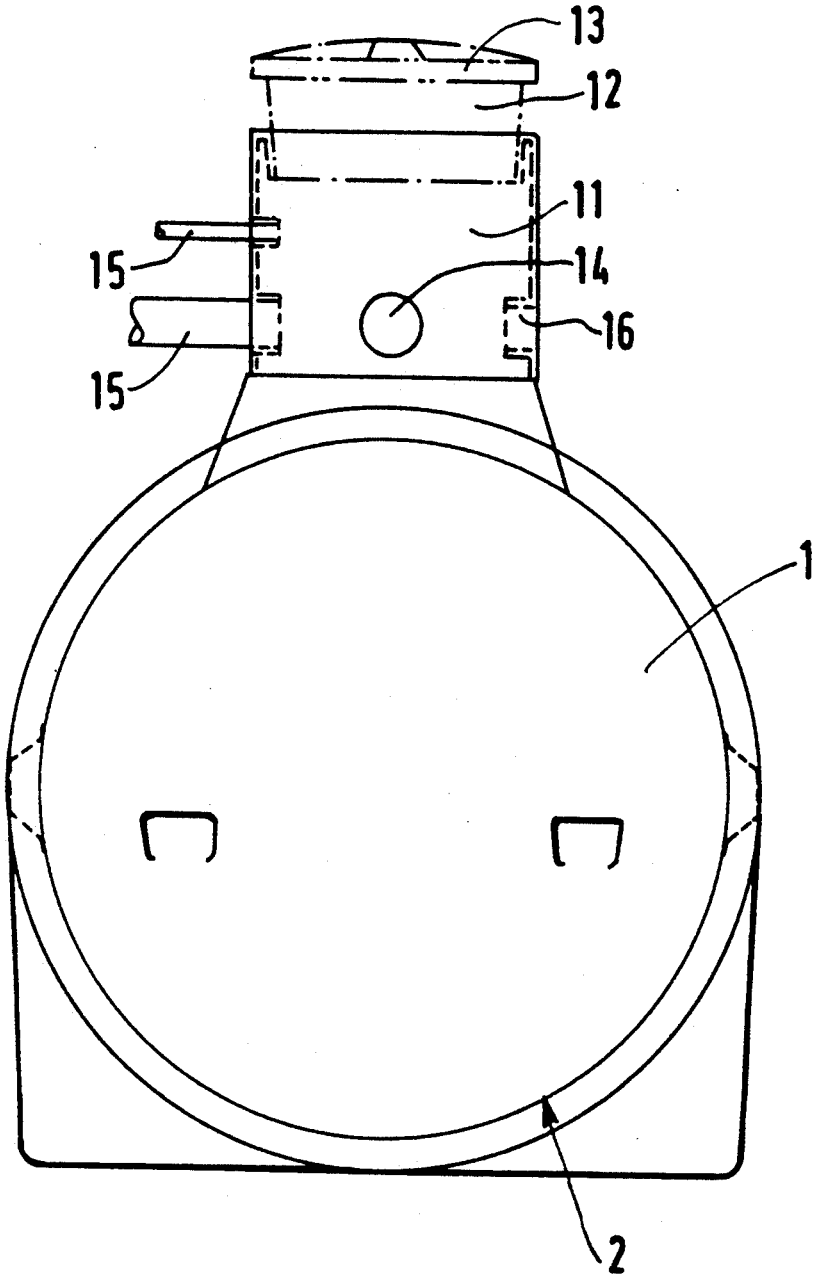
FIG. 2 is a front view of one extremity.

The septic tank shown in FIGS. 1 and 2 appears as a cylindrical cistern 1 advantageously made of a moulded synthetic material whose periphery forms reinforcement undulations 2 and which rests on the ground via one of its generating lines and via stabilizer feet 3. The upper portion of the tank comprises two circular openings 4 and 5. A basin 19 is provided plumb with the opening 4, this basin penetrating inside the cistern and used as a support and communicating via a perforated bottom 6 with an interchangeable prefilter cartridge 7 and containing flocculi of a filtering material. A tank outlet pipe 8 for removing waste water in the irrigation direction opens into the basin 19. The opening 4 is covered with an access gully 9 forming a casing above the cistern and closed by a stopper 10.

A fluid collector chamber 11 is mounted above the other opening 5, this chamber being nested and fixed inside said cistern opening. This chamber is blocked off by a stopper 12 covered with a covering cap 13 located at roughly the same level as the adjacent access gully 9. A pipe 14 for admitting degradable substances opens into this chamber and also has available a plurality of inlet orifices with variable diameters 15 distributed over its periphery and height, these orifices allowing for the connection of other waste water pipes of variable origins and diameters. Finally, the chamber is provided with a ventilation hole 16.

The fluids admitted into the collector chamber 11 are directed via an outlet 17 towards a slanted plunging tube 18 which distributes them towards one extremity of the cistern.

The septic tank with an incorporated collector chamber greatly facilitates the task of the installer who does not have to create a separate collector. The connections are that much simpler as the chamber and the access gully of the prefilter are flush with the level of the ground. So as to render much easier production of the tank, it is possible to provide openings having the same diameter and placed symmetrically, either opening being pre-equipped in the factory or equipped on site, so as to indifferently receive the collector chamber and the prefilter system. When the cistern is installed, the connection of the fluid intake pipes to the incorporated chamber is effected extremely easily by the local installer.

The cistern may possibly be equipped with the prefilter system and, in the absence of the prefilter, only one of the two openings is used for mounting the collector chamber, the other opening remaining blocked off.

The invention is not merely restricted to the embodiment descerbed but also covers all possible constructive variants.

What is claimed is:

1. A septic tank comprising:

a cistern having an upstream and a downstream end, the cistern having a first sealable upper opening disposed at said upstream end;

a collector chamber provided on said first sealable upper opening and having an outlet communicating with said cistern;

at least one degradable substances intake pipe connected to said collector chamber for passing degradable substances to said cistern via said collector chamber;

at least one pipe for removing said degradable substances from said cistern and disposed at said downstream end of said cistern;

a plurality of waste water pipe connecting means on said collector chamber for the connection of a plurality of waste water pipes to said collector chamber;

a second sealable upper opening in said cistern, said second sealable upper opening being disposed at the downstream end of said cistern; and a basin and a prefilter cartridge provided on said second sealable upper opening.

2. The septic tank according to claim 1, wherein said first and second sealable upper openings in said cistern have the same diameter.

3. The septic tank according to claim 1, wherein said at least one pipe for removing sustances from said cistern is in communication with said cistern via said basin and prefilter cartridge.

4. The septic tank according to claim 1, further comprising an access gully disposed above said basin, and a stopper disposed at a top portion of said access gully.

5. A septic tank comprising:

a cistern having an upstream and a downstream end, the cistern having a first sealable upper opening disposed at said upstream end;

a collector chamber provided on said first sealable upper opening and having an outlet communicating with said cistern;

at least one degradable substances intake pipe connected to said collector chamber for passing degradable substances to said cistern via said collector chamber;

at least one pipe for removing said degradable substances from said cistern and disposed at said downstream end of said cistern; and a plurality of waste water pipe connecting means on said collector chamber for the connection of a plurality of waste water pipes to said collector chamber;

wherein said plurality of waste water pipe connecting means provided on said collector chamber are of varying diameters and are distributed over the height and periphery of said collector chamber.

6. The septic tank according to claim 5, further comprising a slanted plunging tube disposed between said collector chamber and said cistern for directing substances from said collector chamber toward said upstream end of said cistern.

* * * * *